US010125328B2

(12) United States Patent
Eizenga et al.

(10) Patent No.: US 10,125,328 B2
(45) Date of Patent: Nov. 13, 2018

(54) PROCESSES FOR SEPARATING MULTIPLE STREAMS FROM A FEED

(71) Applicant: UOP LLC, Des Plaines, IL (US)

(72) Inventors: Donald A. Eizenga, Elk Grove Village, IL (US); Xin X. Zhu, Long Grove, IL (US); Joel Kaye, Long Grove, IL (US); David E. Bachmann, Deer Park, IL (US)

(73) Assignee: UOP LLC, Des Plaines, IL (US)

( * ) Notice: Subject to any disclaimer, the term of this patent is extended or adjusted under 35 U.S.C. 154(b) by 101 days.

(21) Appl. No.: 15/281,948

(22) Filed: Sep. 30, 2016

(65) Prior Publication Data

US 2017/0096609 A1 Apr. 6, 2017

Related U.S. Application Data

(60) Provisional application No. 62/235,689, filed on Oct. 1, 2015.

(51) Int. Cl.
*C10G 67/02* (2006.01)

(52) U.S. Cl.
CPC ..... *C10G 67/02* (2013.01); *C10G 2300/202* (2013.01)

(58) Field of Classification Search
CPC ..... C10G 67/02
See application file for complete search history.

(56) References Cited

U.S. PATENT DOCUMENTS

| | | | | |
|---|---|---|---|---|
| 2,295,256 | A | 9/1942 | Brugma | |
| 4,673,490 | A | 6/1987 | Subramanian et al. | |
| 2002/0170714 | A1* | 11/2002 | Davis | C10G 2/00 166/303 |
| 2010/0025221 | A1 | 2/2010 | Agrawal et al. | |

FOREIGN PATENT DOCUMENTS

| | | | |
|---|---|---|---|
| DE | 19806324 | C1 | 6/1999 |
| JP | 61091288 | A | 5/1986 |

OTHER PUBLICATIONS

Biman Das et al., DE 19806324 C1, English translation (1999).*
Dejanovié, et al., "Dividing wall column—A breakthrough towards sustainable distilling", Chemical Engineering and Processing: Process Intensification (2010), v 49, n 6, p. 559-580.
Giridhar, et al., "Synthesis of distillation configurations: I. Characteristics of a good search space", Computers and Chemical Engineering (2010), v 34, n 1, p. 73-83.

* cited by examiner

*Primary Examiner* — Randy Boyer

(57) ABSTRACT

Processes for separating a feed stream for a combined hydrotreating zone into multiple components. The hydrotreating zone receives at least two streams from the separation, preferably a naphtha stream and a diesel stream. The two streams are treated in the hydrotreating zone and then separated into naphtha and diesel streams. In at least one embodiment, three separation columns are used. In at least one embodiment, two separation columns are used.

19 Claims, 2 Drawing Sheets

PROCESSES FOR SEPARATING MULTIPLE STREAMS FROM A FEED

CROSS-REFERENCE TO RELATED APPLICATION

This application claims priority from Provisional Application No. 62/235,689 filed Oct. 1, 2015, the contents of which are hereby incorporated by reference.

FIELD OF THE INVENTION

The present invention relates generally to processes for separating a stream into multiple streams, and more particularly to processes for separating a feed into at least two streams that are hydrotreated in a combined hydrotreating unit.

BACKGROUND OF THE INVENTION

Petroleum refining and petrochemical processing units frequently utilized an atmospheric fractionation column for separating a feed, such as crude oil or condensate from natural gas, into multiple streams such as light ends, naphtha, distillate (kerosene and/or diesel), and atmospheric residue. The naphtha stream may be separated into a liquid petroleum gas (LPG) and naphtha in a light ends column (stabilizer). After separation, the naphtha and distillate are then separately hydrotreated for the production of low sulfur fuels (e.g. diesel) and as pretreatment for further refining processes (e.g. naphtha to reforming and isomerization for gasoline production).

For small refineries which may be designed and constructed as modular refineries, the naphtha and distillate streams can be hydrotreated in a combined unit. An example of such a refinery is one which processes shale gas condensates, but other condensates, light crudes, and even heavier crudes could be suitable feeds for such a modular refinery with a combined hydrotreating unit.

One potential drawback associated with combined hydrotreating is that naphtha and distillate products must be separated after hydrotreating. While some separation of the feed streams into multiple streams is desired to remove light components, such as LPG, or heavier residue, the current upstream separation provides large fractionations sections that are expensive to build. Furthermore, these separation sections are typically operated in such a manner that provides stringent separation of the distillate and naphtha products which is energy intensive and expensive to operate. However, since these streams are combined in a combined hydrotreating unit, high quality separation upstream of the hydrotreating unit results in unnecessary use of capital and energy.

Therefore, there remains a need for an effective and efficient process for separating the feed stream for a combined hydrotreating unit.

SUMMARY OF THE INVENTION

One or more processes have been invented which provide effective and efficient processed for separating a feed stream for a combined hydrotreating unit into multiple streams.

In a first aspect of the invention, the present invention may be characterized broadly as providing a process for separating multiple hydrocarbon streams from a feed by: separating a feed in a first separation zone having a column into an overhead stream including LPG, and a bottoms stream including heavy naphtha; heating a least a portion of the bottoms stream; separating the bottoms stream in a second separation zone having a column into a naphtha stream comprising at least heavy naphtha, a distillate stream comprising at least heavy distillate, and a residue stream, wherein the column in the second separation zone receives a stripping gas; and, hydrotreating the distillate stream and the naphtha stream in a combined hydrotreating zone, the combined hydrotreating zone receiving a gaseous stream comprising hydrogen and containing a catalyst, the combined hydrotreating zone providing a hydrotreated effluent.

In at least one embodiment, the process includes heating the column in the first separation zone with a hot oil reboiler.

In at least one embodiment, an operating pressure of the column in the second separation zone is between approximately 13.8 to 172 kPag (2 to 25 psig).

In at least one embodiment, the stripping gas comprises steam.

In at least one embodiment, the overhead stream from the column in the first separation zone includes light naphtha. It is contemplated that the bottoms stream from the column in the first separation zone is relatively free of LPG. It is also contemplated that the process includes separating the overhead stream from the column in the first separation zone in a third separation zone having column into an LPG stream and a light naphtha stream. It is also contemplated that the light naphtha from the first separation zone is relatively free of LPG, and the process includes hydrotreating the light naphtha stream in the combined hydrotreating zone.

In at least one embodiment, the bottoms stream from the column in the first separation zone includes light naphtha, and wherein the naphtha stream from the column in the second separation zone includes light naphtha. It is contemplated that the light naphtha from the first separation zone is relatively free of LPG.

In a second aspect of the present invention, the present invention may be broadly characterized as providing a process for separating multiple hydrocarbon streams from a feed by: heating a feed stream to provide a heated feed stream; passing the heated feed stream to a first separation zone having a column and being configured to provide an overhead stream comprising at least LPG and a bottoms stream comprising at least heavy naphtha; heating at least a portion of the bottoms stream to provide a heated bottoms stream; passing the heated bottoms stream to a second separation zone having a column and being configured to provide a naphtha stream comprising at least heavy naphtha, a distillate stream comprising at least heavy distillate, and a residue stream; passing a stripping gas into the column in the second separation zone; and, passing the naphtha stream and the heavy distillate stream to a combined hydrotreating zone, the combined hydrotreating zone receiving a gaseous stream comprising hydrogen and containing a catalyst, the combined hydrotreating zone providing a hydrotreated effluent.

In at least one embodiment, the process includes heating the first separation zone with a hot oil reboiler.

In at least one embodiment, the process includes separating the bottoms stream from the first separation zone into a liquid phase and a gaseous phase, wherein the liquid phase is heated to provide the heated bottoms stream. The process may further include passing the gaseous phase of the bottoms stream to the column in the second separation zone.

In at least one embodiment, the overhead stream from the first separation zone includes light naphtha and the process includes passing the overhead stream from the first separation zone to a third separation zone having a column and being configured to provide an LPG stream and a light naphtha stream. It is contemplated that the process further includes passing the light naphtha stream to the combined hydrotreating zone.

In at least one embodiment, the bottoms stream from the first separation zone comprises light naphtha. It is contemplated that the naphtha stream from the second separation zone comprises light naphtha.

In a third aspect of the present invention, the present invention may be generally characterized as providing a process for separating multiple hydrocarbon streams from a feed by: passing a feed stream to a first separation zone having a column and being configured to provide an overhead stream comprising at least LPG and a bottoms stream comprising at least heavy naphtha; separating the bottoms stream from the first separation zone into a liquid phase and gaseous phase; heating the liquid phase to formed a heated bottoms stream; passing the gaseous phase into a second separation zone; passing the heated bottoms stream to the second separation zone, the second separation zone having a column and being configured to provide into a naphtha stream comprising at least heavy naphtha, a distillate stream comprising at least heavy distillate, and a residue stream; passing a stripping gas into the column in the second separation zone; and, passing the naphtha stream and the heavy distillate stream to a combined hydrotreating zone, the combined hydrotreating zone receiving a gaseous stream comprising hydrogen and containing a catalyst, the combined hydrotreating zone providing a hydrotreated effluent.

In at least one embodiment, the process includes separating the overhead stream from the first separation zone into an LPG stream and a light naphtha stream in a third separation zone having a column and, passing the light naphtha stream from the third separation zone to the combined hydrotreating zone.

Additional aspects, embodiments, and details of the invention, all of which may be combinable in any manner, are set forth in the following detailed description of the invention.

DETAILED DESCRIPTION OF THE DRAWINGS

One or more exemplary embodiments of the present invention will be described below in conjunction with the following drawing figures, in which.

DETAILED DESCRIPTION OF THE INVENTION

As mentioned above, various processes for separating a feed stream for a combined hydrotreating unit into multiple streams have been invented. The present invention provides more efficient separation of a feed streams for a combined hydrotreating unit by rigorously separating LPG from the heavier components. In a typical refinery, crude oil is first fractionated in an atmospheric distillation column to separate lighter components including sour gas, e.g., hydrogen sulfide, and light hydrocarbons such as methane, ethane, propane, and butanes. Naphtha (hydrocarbons boiling typically between 36 to 180° C. (96.8 to 356° F.)), kerosene, (hydrocarbons boiling typically between 180 to 240° C. (356 to 464° F.)), and gas oil (hydrocarbons boiling typically between 240 to 370° C. (464 to 698° F.)) are typically recovered in streams taken as sidecuts from the distillation column. Atmospheric residue, which is the hydrocarbon fractions boiling above 370° C. (698° F.), is recovered as a bottoms stream. The atmospheric residue from the atmospheric distillation column is either used as fuel oil or sent to a vacuum distillation unit, depending on the configuration of the refinery. The main products from the vacuum distillation unit include vacuum gas oil, having hydrocarbons boiling in the range of 370 to 520° C. (698 to 968° F.), and vacuum residue, encompassing hydrocarbons boiling above 520° C. (968° F.). In the various processes of the present invention, the LPG feed stream components, which do not require hydroprocessing are separated, and the atmospheric residue, which is not economical to co-process in a combined hydrotreating unit, are rigorously separated. Indeed, any LPG sent to the combined hydrotreating unit downstream would increase the cost of that unit, and fractionation of products would be needed in any case which could lead to losses of LPG into fuel gas due to the presence of dissolved gasses (including hydrogen) in the fractionation columns downstream of the hydrotreating reactors. The up-front fractionation minimizes LPG loss to fuel gas. While the distillate and naphtha streams are also separated, the separation does not have to be as rigorous, thus providing an efficient manner to separate a feed stream for a combined hydrotreating unit. However, separating a distillate stream before being processed, allows for the use of energy efficient heat exchange designs which transfer the heat from the distillate stream to another process stream.

With these general principles in mind, one or more embodiments of the present invention will be described with the understanding that the following description is not intended to be limiting.

Figure 1:
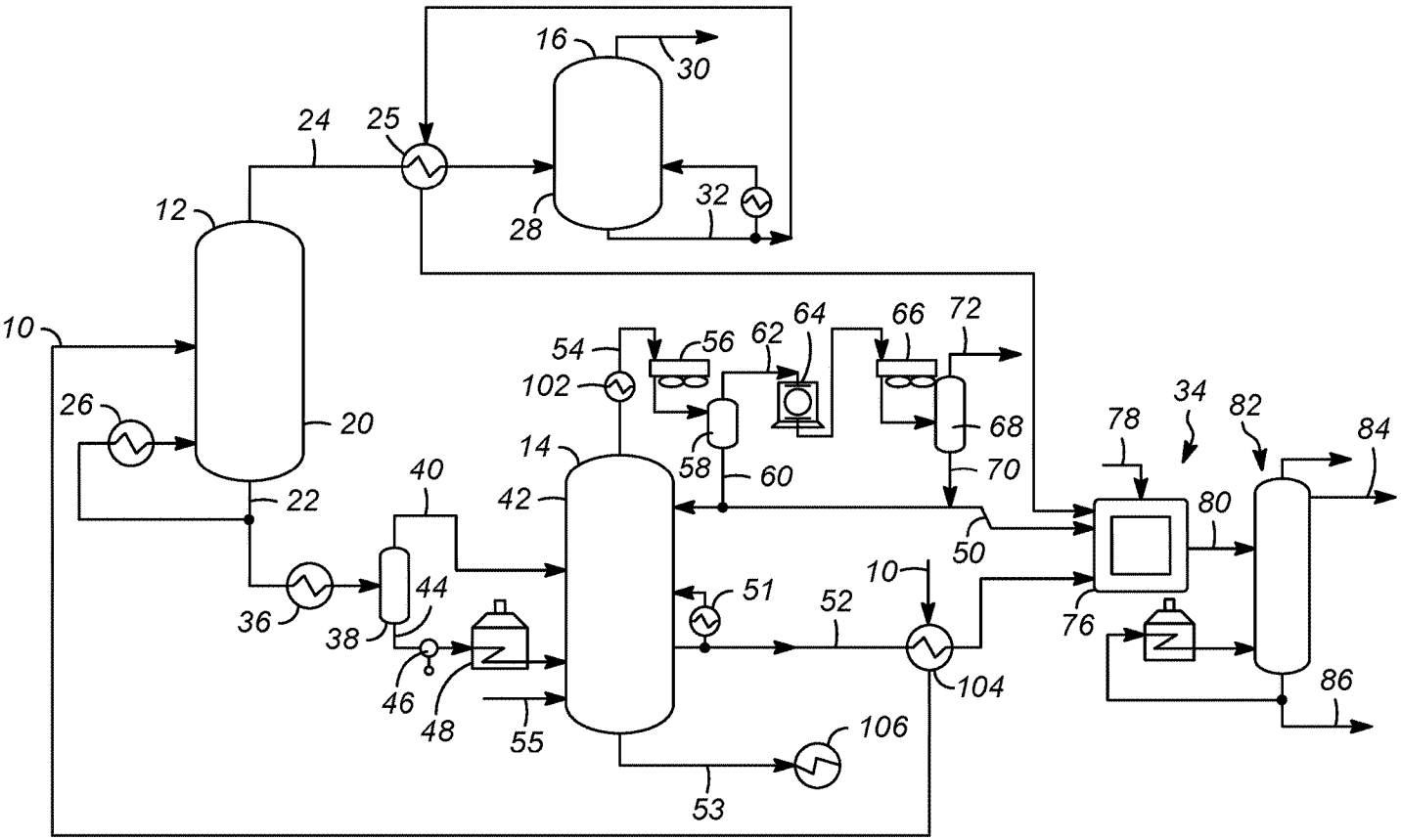
FIG. 1 shows a process flow diagram of at least one embodiment of the present invention.

As shown in FIG. 1, in one or more embodiments of the present invention the traditional atmospheric distillation column used to separate a feed stream 10 comprising crude oil or condensate from natural gas deposits is replaced with three separation zones 12, 14, 16 each having a column. As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones. Furthermore, the term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottom stream back to the bottom of the column. Feeds to the columns may be preheated. Columns (especially those with stripping gas at the bottom) may use a feed heater rather than a reboiler. The top pressure is the pressure of the overhead vapor at the outlet of the column. The bottom temperature is the liquid bottom outlet temperature. Overhead lines and bottom lines refer to the net lines from the column downstream of the reflux or re-boil to the column.

Returning to FIG. 1, the feed stream 10 may be heated in one or more heat exchangers (discussed below) and then passed to the first separation zone 12 which may include a column 20, which may comprise a splitter column. The feed stream 10 may be passed to the column 20 from a desalter (not shown) and may be heated before and after desalting. The column 20 in the first separation zone 12 is much smaller compared to the traditional fractionation column, having approximately six stages, compared to 20 or more stages typically present in the fractionation column. The six stages in the column 20 in the first separation zone 12 typically will not achieve rigorous separation, but will provide a sufficient level of separation while not requiring such a large fractionation column or excessive energy.

The column 20 in the first separation zone 12 will separate the components of the feed stream 10 into a bottoms stream 22 and an overhead stream 24. A water wash may be used on the overhead of column 20 to remove corrosive salts from the feed stream 10 (not shown). The operating pressure of the column 20 in the first separation zone 12 is sufficient to ensure that LPG (and lighter components) in the feed stream 10 is separated into the condensed liquid overhead stream 24. Often, this pressure will depend on the amount of the LPG components in the feed stream 10, and the amount of light naphtha that is lifted up the column. For example, the operating pressure of the column 20 in the first separation zone 12 may be between approximately (i.e., +/−5%) 172 to 345 kPag (25 to 50 psig). In addition to LPG, the overhead stream 24 will include at least some of the light naphtha acting as a sponge liquid to ensure that LPG components remain liquid in the overhead stream 24.

The column 20 in the first separation zone 12 may have a very low duty re-boiler 26 to reheat a portion of the bottoms stream 22 and strip most of the LPG and light naphtha. The re-boiler 26 may be operated to achieve a minimum reflux rate, for example a reflux to feed ratio of approximately 0.05. This ratio also acts as a wash to ensure heavy distillate and residue does not rise up the column 20 in the first separation zone 12. The bottoms stream 22 from the column 20 in the first separation zone 12 may include heavy naphtha to minimize the process temperatures in the re-boiler 26 and allow for a hot oil heating medium to be utilized. Light naphtha and heavy naphtha are not rigorously separated with the low number of stages and minimum energy input to the column 20 in the first separation zone 12. A hot oil system may be utilized including a single hot oil heater which can be used to supply multiple low cost hot oil exchangers to minimize the number of high cost fired heaters in the overall complex and thereby optimize capital cost. The bottoms stream 22 will be relatively free of LPG. By relatively free it is meant that a stream contains less than 5 wt %, or preferably less than 1 wt % of the identified compound, in this case LPG. The bottoms stream 22 from the column 20 in the first separation zone 12 is passed to the second separation zone 14 (discussed in more detail below).

The overhead stream 24 from the column 20 in the first separation zone 12 may be heated in a feed-bottoms heat exchanger 25 and then passed to the third separation zone 16. The third separation zone 16 includes a column 28, which may comprise a stabilizer column. The column 28 in the third separation zone 16 may include approximately 35 stages and is used for rigorous separation between the LPG and the light naphtha components from the overhead steam 24 of the column 20 in the first separation zone 12 into an LPG stream 30 and a light naphtha stream 32 comprising mostly C5 and C6 hydrocarbons, but including some, for example, 30 to 40 wt %, heavy naphtha compounds (boiling range between 120 to 180° C. (248 to 356° F.), or between 120 to 200° C. (248 to 392° F.)) and some small amounts (less than 0.5 wt %) of distillate.

Preferably, the third separation zone 16 condenses the overhead stream and maintain the LPG stream 30 in liquid phase. The light naphtha stream 32 from the column 28 in the third separation zone 16 is relatively free of LPG components. In one or more embodiments, the operating pressure of the column 28 in the third separation zone 16 may be at least approximately 827 kPag (120 psig). While the column 28 in the third separation zone 16 may be similar in pressure to the typical fractionation column, the column 28 in the third separation zone 16 is only separating LPG and light naphtha, and thus energy consumption and column temperatures are lower compared to the separation of LPG from full range naphtha (having a T5 between 10° and 40° C. (50° and 104° F.) and a T90 between 120° and 175° C. (248° and 347° F.) or heavier components. As used herein, the term "T5" or "T90" means the temperature at which 5 volume percent or 90 volume percent, as the case may be, respectively, of the sample boils using ASTM D-86.

The light naphtha stream 32 may be withdrawn from the column 28 in the third separation zone 16, and a portion of same re-boiled with, for example, hot oil. The re-boiler duty input and number of stages are variable per standard procedures for rigorous fractionation or component separation. The light naphtha stream 32 may be used to heat the overhead stream 24 in the feed-bottoms exchanger 25 and then be passed to a combined hydrotreating zone 34 (discussed below).

Returning to the first separation zone 12, the bottoms stream 22 from the column 20 in the first separation zone 12 may be heated, with various process streams (discussed below), via heat exchanger 36 with a hot oil stream, or both. After being heated, the bottoms stream 22 may be passed to a flash vessel 38 operated and configured to separate naphtha components from the bottoms stream 22. A gaseous naphtha stream 40 may be passed from the flash vessel 38 to the second separation zone 14. A naphtha lean bottoms stream 44 from the flash vessel 38 may be withdrawn, via a pump 46, heated in a heater 48 and then also passed into the second separation zone 14. Since most of the naphtha components have been removed from the naphtha lean bottoms stream 44, the remaining components, comprising diesel range and residue may be heated with the heater 48 subject to the typical constraints of 385° C. (725° F.) maximum temperature and 80 wt % maximum vaporization to prevent excessive cracking and heater fouling/coking.

The second separation zone 14 includes a column 42 that is operated to separate a heavy naphtha stream 50 and a distillate stream 52 from an atmospheric residue stream 53, preferably at low pressure, for example between approximately 13.8 and 172 kPag (2 and 25 psig), or approximately 69 kPag (10 psig). The heavy naphtha stream 50 may have a boiling point range between 36° and 180° C. (96.8° and 356° F.) (with a T5 between 10° and 60° C. (50° and 140° F.) and a T90 between 120° and 200° C. (248° and 392° F.)) and may comprise light naphtha (about 20 wt % or less) and less than 2 wt % LPG. The distillate stream 52 comprises predominantly hydrocarbons having a boiling point in the range of 180° to 370° C. (356° to 698° F.) (with a T5 between 120° and 180° C. (248° and 356° F.) and a T90 between 330° and 370° C. (626° and 698° F.)) and may further comprise less than 20 wt % naphtha and less than then 3 wt % atmospheric residue. The atmospheric residue stream 53 comprises hydrocarbons having a boiling point above 370° C. (698° F.) (with a T5 between 320° and 390° C. (608° and 734° F.)).

The processing of the atmospheric residue stream 53 is known in the art and not necessary for the practicing or understanding of the present invention; however, as discussed below, it is contemplated that this stream is used to heat one or more other streams, such as bottoms stream 22, in a heat exchanger 106 (see FIG. 2). A portion of the distillate stream 52 can be used in a pump around 51 to also heat the bottoms stream 22. Unlike current designs, the separation between the heavy naphtha stream 50 and the distillate stream 52 in the column 42 in the second separation zone 14 does not need to be as rigorous since these components will be passed to the combined hydrotreating zone 34. For this reason, the column 42 may include only approximately 15 stages of separation, and utilize a minimum heater 48 duty input, low reflux (reflux to distillate or reflux to feed ratios of <0.5), and minimum amount of stripping gas (discussed below) so as to remove distillate from the residue stream 53. More particularly, the distillate stream 52 is primarily withdrawn as a separate side stream from the column 42 in the second separation zone 14 so that it may be drawn at a higher temperature than if it were allowed to pass through the overheads product condenser. The distillate stream 52 can also be used to heat the feed stream 10, for example in heat exchanger 104, and it requires less energy for re-heating within the combined hydrotreating zone 34. Notwithstanding same, in some embodiments, it is contemplated that the heavy naphtha stream 50 and the distillate stream 52 are not separated.

A stripping medium (or gas) 55 may be passed to the column 42 in the second separation zone 14 for stripping diesel from the atmospheric residue stream 53. The stripping medium 55 may comprise natural gas, fuel gas, or preferably steam. If a hydrocarbon gas is used, an overhead stream 54 may be used to heat the feed stream 10 in a heat exchanger 102 and then passed to an air cooler 56 and then to a receiver 58. A liquid stream 60 from the receiver 58 will comprise heavy naphtha, and a portion of same may be used as a reflux to the column 42 in the second separation zone 14. A vapor stream 62 from the receiver 58 may be compressed in a compressor 64, passed to a second air cooler 66 and then passed to a second receiver 68. A liquid stream 70 from the second receiver 68 will also comprise heavy naphtha and may be combined with the liquid stream 60 from the first receiver 58 to provide the heavy naphtha stream 50. A vapor stream 72 from the second receiver 68 will comprise fuel gas that may be processed and used as is known in the art. Stripping with a hydrocarbon gas leads to loss of light material into the fuel gas and requires more equipment. These are offsetting capital/operating costs relative to the steam system, but product loss to fuel gas is more severe.

Accordingly, stripping with steam is the more traditional and standard method. An advantage of steam is that it is a fully condensing liquid at the column overhead, so light material will remain as liquid with the heavy naphtha stream 50. With a steam system, the compressor 64, second air cooler 66 and second receiver 68 are not required (see FIG. 2).

As shown in FIG. 1, the combined hydrotreating zone 34 comprises a hydrotreating reactor 76 which receives at least one naphtha stream, for example the light naphtha stream 32 or the heavy naphtha stream 50 and at least one diesel stream, for example, the distillate stream 52. Although each stream is depicted as passing into the hydrotreating reactor 76 individually, one or more of these steams may be combined. Additionally, the hydrotreating reactor 76 will receive a hydrogen-containing treat gas stream 78. Although not depicted as such, the combined hydrotreating zone 34 typically also includes a feed surge drum, charge pumps, a combined feed exchanger, feed heater, products condenser, separator, recycle gas compressor, and wash water stream. The design and configuration of the combined hydrotreating zone 34 is known to those of ordinary skill in the art.

The hydrotreating reactor 76 comprises one or more suitable catalysts which are primarily active for the removal of heteroatoms, such as sulfur and nitrogen, saturation of olefins and for some hydrogenation of aromatics present in the naphtha and diesel streams. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VI metal may be present in an amount ranging from about 2 to about 20 wt %, preferably from about 4 to about 12 wt %. The Group VI metal will typically be present in an amount ranging from about 1 to about 25 wt %, preferably from about 2 to about 25 wt %. Additionally, typical hydrotreating temperatures range from about 204° to 440° C. (400° to 824° F.) with pressures from about 3.6 to 17.3 MPa (500 to 2,500 psig), preferably from about 3.6 to 7.0 MPa (500 to 1,000 psig).

A hydrotreated effluent 80 from the combined hydrotreating zone 34 may be passed to a product recovery zone 82 which may include various separation vessels and columns. The various separation columns and vessels in the product recovery zone 82 will rigorously separate the hydrotreated effluent 80 into at least a naphtha product stream 84 and a diesel product stream 86 in order to meet specifications for final products and/or further processing. Additionally, a sour water stream and a recycled gas stream may also be provided (not shown).

Figure 2:
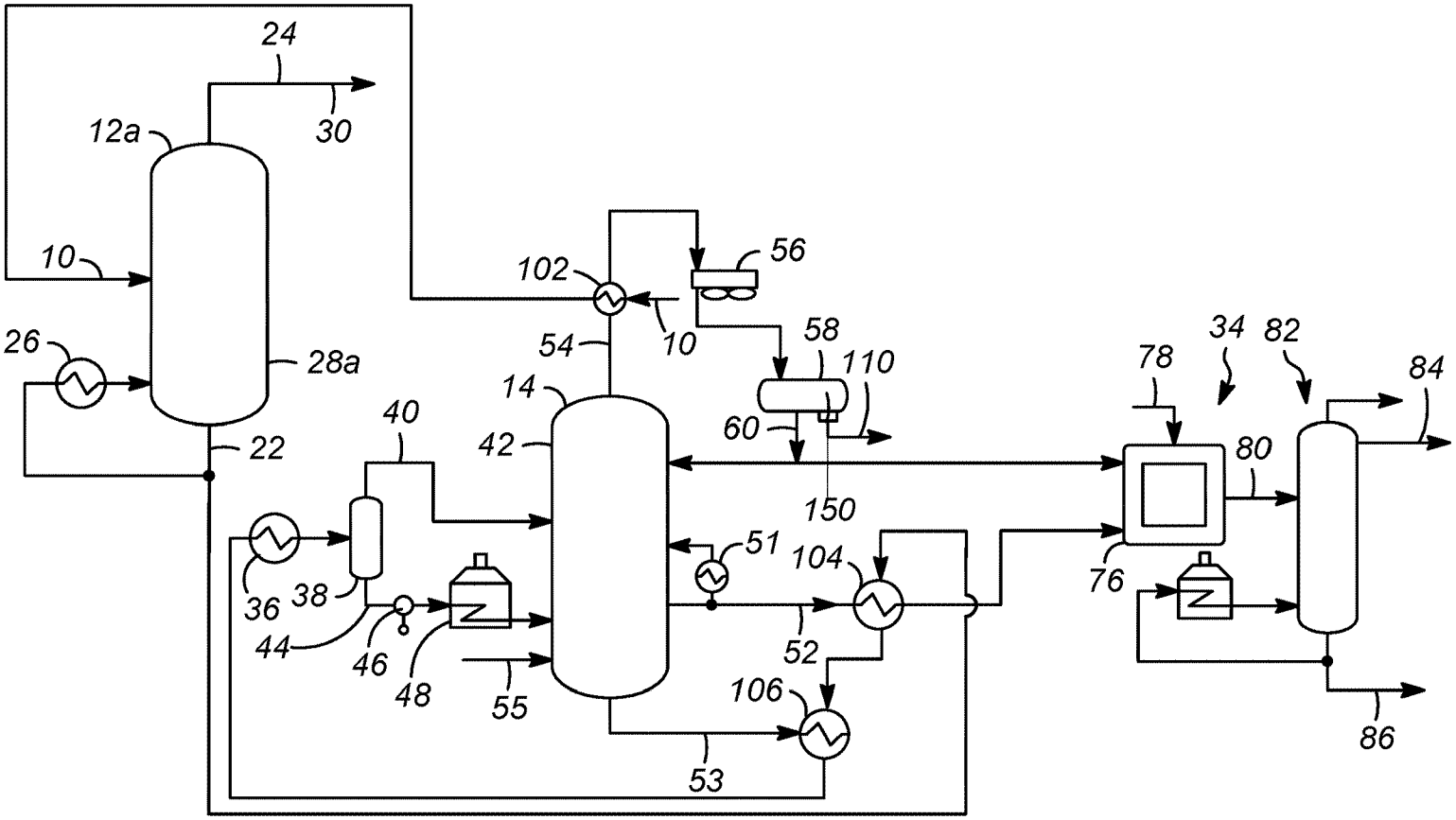
FIG. 2 shows another process flow diagram of one or more embodiments of the present invention.

Turning to FIG. 2, in at least one embodiment of the present invention, the traditional atmospheric distillation column used to separate the feed stream 10, preferably comprising crude oil or condensate from natural gas deposits, is replaced with only two separation zones 12*a*, 14*a*.

As depicted, the column 28*a* in the first separation zone 12*a* separates the feed stream 10 into the overhead stream 24 and the bottoms stream 22. The overhead stream 24 may comprise the LPG stream 30 from FIG. 1, and the bottoms stream 22 may include naphtha (light and heavy), distillate (light and heavy) and residue. The column 28*a* in the first separation zone 12*a* in FIG. 2 is operated to ensure that the bottoms stream 22 is relatively free of LPG, and may include approximately 40 stages and have an operating pressure of approximately 827 kPag (120 psig) or greater.

The bottoms stream 22 from the column 28*a* in the first separation zone 12*a* may, similar to process depicted in FIG. 1, be heated and then passed to the flash vessel 38 to separate the gaseous naphtha stream 40 which is passed to the second separation zone 14*a*. The naphtha lean bottoms stream 44 from the flash vessel 38 may be withdrawn, via a pump 46, heated in a heater 48 and then also passed into the second separation zone 14*a*.

As shown in FIG. 2, the column 42*a* in the second separation zone 14*a* will separate the components of the bottoms stream 22 from the column 28*a* in the first separation zone 12*a* into a naphtha stream 150, including both light and heavy naphtha, the distillate stream 52, and the residue stream 53. Accordingly, in some embodiments of the present invention, the column 42*a* in the second separation zone 14*a* may include approximately 15 stages of separation and have an operating pressure of approximately 13.8 to 172 kPag (2 to 25 psig), or approximately 69 kPag (10 psig). Again, the column 42*a* in the second separation zone 14*a* may receive a stripping medium 55 (preferably steam).

The overhead stream 54 from the column 42*a* in the second separation zone 14*a* may be used to heat the feed stream 10 via heat exchanger 102, and then cooled in the air cooler 56 and passed to the receiver 58. A liquid hydrocarbon stream comprising the naphtha stream 150 is passed to the combined hydrotreating zone 34. A portion of the naphtha stream 150 may also be used as a reflux stream. As shown a water stream 110 may also be removed from the receiver 58. However, as shown in FIG. 1 and described above, if the stripping medium 55 comprises hydrocarbon gas (such as fuel gas) the water stream 110 will not be recovered, and more equipment, such as the compressor 64, second air cooler 66 and second receiver 68 will be required.

The distillate stream 52 can be used in a pump around 51 to heat the bottoms stream 22, and then returned to the column 42*a* in the second separation zone 14*a*. The net distillate stream 52 may also be used to exchange heat with the bottoms stream 22 from the column 28*a* in the first separation zone 12*a* in a heat exchanger 104. The residue stream 53 may be used to heat the bottoms stream 22 from the column 28*a* in the first separation zone 12*a* in the heat exchanger 106 and processed further as is known in the art, for example by being sold as a product to another refinery (typically one that is larger), or by being used as fuel oil.

The combined hydrotreating zone 34, and the product recovery zone 82 may be the same as discussed above with respect to FIG. 1. Accordingly, those portions of the above description are hereby incorporated into the description of FIG. 2.

In a theoretical modeling using a process according to various aspects discussed herein for a refinery processing 25,000 BPSD of a feed stream comprising a light condensate case (with steam stripping), the overall exchange duty was reduced by approximately 31 MMBTU/hr, the heater and hot oil duty was decreased by approximately 16 MMBTU/hr, and the primary fired heater duty was reduced from 40 to 13 MMBTU/hr. The capital costs for both configurations (FIGS. 1 and 2) were similar and comprised about 95% of the capital for a typical fractionation unit which would be required for separate hydrotreating. This results in a savings of approximately $300 k in equipment cost. Accordingly, while the naphtha and diesel are still being separated twice, the separation upstream of the combined hydrotreating provided a more energy efficient separation compared to a typical fractionation column design.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understanding the embodiments of the present invention.

Specific Embodiments

While the following is described in conjunction with specific embodiments, it will be understood that this description is intended to illustrate and not limit the scope of the preceding description and the appended claims.

A first embodiment of the invention is a process for separating multiple hydrocarbon streams from a feed, the process comprising separating a feed in a first separation zone having a column into an overhead stream including LPG, and a bottoms stream including heavy naphtha; heating a least a portion of the bottoms stream; separating the bottoms stream in a second separation zone having a column into a naphtha stream comprising at least heavy naphtha, a distillate stream comprising at least heavy distillate, and a residue stream, wherein the column in the second separation zone receives a stripping gas; and, hydrotreating the distillate stream and the naphtha stream in a combined hydrotreating zone, the combined hydrotreating zone receiving a gaseous stream comprising hydrogen and containing a catalyst, the combined hydrotreating zone providing a hydrotreated effluent. An embodiment of the invention is one, any or all of prior embodiments in this paragraph up through the first embodiment in this paragraph further comprising heating the column in the first separation zone with a hot oil reboiler. An embodiment of the invention is one, any or all of prior embodiments in this paragraph up through the first embodiment in this paragraph wherein an operating pressure of the column in the second separation zone is between approximately 13.8 to 172 kPag. An embodiment of the invention is one, any or all of prior embodiments in this paragraph up through the first embodiment in this paragraph wherein the stripping gas comprises steam. An embodiment of the invention is one, any or all of prior embodiments in this paragraph up through the first embodiment in this paragraph wherein the overhead stream from the column in the first separation zone includes light naphtha. An embodiment of the invention is one, any or all of prior embodiments in this paragraph up through the first embodiment in this paragraph wherein the bottoms stream from the column in the first separation zone is relatively free of LPG. An embodiment of the invention is one, any or all of prior embodiments in this paragraph up through the first embodiment in this paragraph further comprising separating the overhead stream from the column in the first separation zone in a third separation zone having column into an LPG stream and a light naphtha stream. An embodiment of the invention is one, any or all of prior embodiments in this paragraph up through the first embodiment in this paragraph wherein the light naphtha from the first separation zone is relatively free of LPG, and the process further comprising hydrotreating the light naphtha stream in the combined hydrotreating zone. An embodiment of the invention is one, any or all of prior embodiments in this paragraph up through the first embodiment in this paragraph wherein the bottoms stream from the column in the first separation zone includes light naphtha, and wherein the naphtha stream from the column in the second separation zone includes light naphtha. An embodiment of the invention is one, any or all of prior embodiments in this paragraph up through the first embodiment in this paragraph wherein the light naphtha from the first separation zone is relatively free of LPG.

A second embodiment of the invention is a process for separating multiple hydrocarbon streams from a feed, the process comprising heating a feed stream to provide a heated feed stream; passing the heated feed stream to a first separation zone having a column and being configured to provide an overhead stream comprising at least LPG and a bottoms stream comprising at least heavy naphtha; heating at least a portion of the bottoms stream to provide a heated bottoms stream; passing the heated bottoms stream to a second separation zone having a column and being configured to provide a naphtha stream comprising at least heavy naphtha, a distillate stream comprising at least heavy distillate, and a residue stream; passing a stripping gas into the column in the second separation zone; and, passing the heavy naphtha stream and the heavy distillate stream to a combined hydrotreating zone, the combined hydrotreating zone receiving a gaseous stream comprising hydrogen and containing a catalyst, the combined hydrotreating zone providing a hydrotreated effluent. An embodiment of the invention is one, any or all of prior embodiments in this paragraph up through the second embodiment in this paragraph further comprising heating the first separation zone with a hot oil reboiler. An embodiment of the invention is one, any or all of prior embodiments in this paragraph up through the second embodiment in this paragraph further comprising separating the bottoms stream from the first separation zone into a liquid phase and a gaseous phase, wherein the liquid phase is heated to provide the heated bottoms stream. An embodiment of the invention is one, any or all of prior embodiments in this paragraph up through the second embodiment in this paragraph further comprising passing the gaseous phase of the bottoms stream to the column in the second separation zone. An embodiment of the invention is one, any or all of prior embodiments in this paragraph up through the second embodiment in this paragraph, wherein the overhead stream from the first separation zone includes light naphtha and wherein the process further comprises passing the overhead stream from the first separation zone to a third separation zone having a column and being configured to provide an LPG stream and a light naphtha stream. An embodiment of the invention is one, any or all of prior embodiments in this paragraph up through the second embodiment in this paragraph further comprising passing the light naphtha stream to the combined hydrotreating zone. An embodiment of the invention is one, any or all of prior embodiments in this paragraph up through the second embodiment in this paragraph wherein the bottoms stream from the first separation zone comprises light naphtha. An embodiment of the invention is one, any or all of prior embodiments in this paragraph up through the second embodiment in this paragraph wherein the naphtha stream from the second separation zone comprises light naphtha.

A third embodiment of the invention is a process for separating multiple hydrocarbon streams from a feed, the process comprising passing a feed stream to a first separation zone having a column and being configured to provide an overhead stream comprising at least LPG and a bottoms stream comprising at least heavy naphtha; separating the bottoms stream from the first separation zone into a liquid phase and gaseous phase; heating the liquid phase to formed a heated bottoms stream; passing the gaseous phase into a second separation zone; passing the heated bottoms stream to the second separation zone, the second separation zone having a column and being configured to provide into a naphtha stream comprising at least heavy naphtha, a distillate stream comprising at least heavy distillate, and a residue stream; passing a stripping gas into the column in the second separation zone; and, passing the naphtha stream and the heavy distillate stream to a combined hydrotreating zone, the combined hydrotreating zone receiving a gaseous stream comprising hydrogen and containing a catalyst, the combined hydrotreating zone providing a hydrotreated effluent. An embodiment of the invention is one, any or all of prior embodiments in this paragraph up through the third embodiment in this paragraph further comprising separating the overhead stream from the first separation zone into an LPG stream and a light naphtha stream in a third separation zone having a column; and, passing the light naphtha stream from the third separation zone to the combined hydrotreating zone.

A fourth embodiment of the invention is a process for treating multiple hydrocarbon streams, the process comprising passing a naphtha stream into a combined hydrotreating zone and passing a distillate stream into the combined hydrotreating zone, wherein the combined hydrotreating zone comprises a vessel receiving a gaseous stream comprising hydrogen and containing a hydrotreating catalyst and being operated to provide a hydrotreated effluent, the vessel in the hydrotreating zone being configured to receive both the naphtha stream and the distillate stream at the same time. An embodiment of the invention is one, any or all of prior embodiments in this paragraph up through the fourth embodiment in this paragraph further comprising passing the hydrotreated effluent to a product recovery zone configured to separate the hydrotreated effluent into at least one naphtha product stream and at least one diesel product stream. An embodiment of the invention is one, any or all of prior embodiments in this paragraph up through the fourth embodiment in this paragraph further comprising passing a feed stream to a first separation zone having a column and being configured to provide an overhead stream comprising LPG and light naphtha and a bottoms stream comprising at least heavy naphtha and distillate; separating the bottoms stream from the first separation zone into a liquid phase and gaseous phase; heating the liquid phase to formed a heated bottoms stream; passing the gaseous phase into a second separation zone; passing the heated bottoms stream to the second separation zone, the second separation zone having a column and being configured to provide a heavy naphtha stream, the distillate stream, and a residue stream; passing a stripping gas into the column in the second separation zone; and, separating the overhead stream from the first separation zone into an LPG stream and a light naphtha stream in a third separation zone having a column, wherein at least one of the light naphtha stream and the heavy naphtha stream comprise the naphtha stream passed to the combined hydrotreating zone. An embodiment of the invention is one, any or all of prior embodiments in this paragraph up through the fourth embodiment in this paragraph further comprising passing a feed stream to a first separation zone having a column and being configured to provide an overhead stream comprising LPG and a bottoms stream comprising at least naphtha and distillate; separating the bottoms stream from the first separation zone into a liquid phase and gaseous phase; heating the liquid phase to formed a heated bottoms stream; passing the gaseous phase into a second separation zone; passing the heated bottoms stream to the second separation zone, the second separation zone having a column and being configured to provide the naphtha stream, the distillate stream, and a residue stream; and, passing a stripping gas into the column in the second separation zone.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A process for separating multiple hydrocarbon streams from a feed, the process comprising:

separating a feed in a first separation zone having a column into an overhead stream including LPG, and a bottoms stream including heavy naphtha;

heating a least a portion of the bottoms stream;

separating the bottoms stream in a second separation zone having a column into a naphtha stream comprising at least heavy naphtha, a distillate stream comprising at least heavy distillate, and a residue stream, wherein the column in the second separation zone receives a stripping gas; and, hydrotreating the distillate stream and the naphtha stream in a combined hydrotreating zone, the combined hydrotreating zone receiving a gaseous stream comprising hydrogen and containing a catalyst, the combined hydrotreating zone providing a hydrotreated effluent.

2. The process of claim 1 further comprising heating the column in the first separation zone with a hot oil reboiler.

3. The process of claim 1 wherein an operating pressure of the column in the second separation zone is between approximately 13.8 to 172 kPag.

4. The process of claim 1 wherein the stripping gas comprises steam.

5. The process of claim 1 wherein the overhead stream from the column in the first separation zone includes light naphtha.

6. The process of claim 5 wherein the bottoms stream from the column in the first separation zone is relatively free of LPG.

7. The process of claim 6 further comprising separating the overhead stream from the column in the first separation zone in a third separation zone having column into an LPG stream and a light naphtha stream.

8. The process of claim 7 wherein the light naphtha from the first separation zone is relatively free of LPG, and the process further comprising hydrotreating the light naphtha stream in the combined hydrotreating zone.

9. The process of claim 1 wherein the bottoms stream from the column in the first separation zone includes light naphtha, and wherein the naphtha stream from the column in the second separation zone includes light naphtha.

10. The process of claim 9 wherein the light naphtha from the first separation zone is relatively free of LPG.

11. A process for separating multiple hydrocarbon streams from a feed, the process comprising:

heating a feed stream to provide a heated feed stream;

passing the heated feed stream to a first separation zone having a column and being configured to provide an overhead stream comprising at least LPG and a bottoms stream comprising at least heavy naphtha;

heating at least a portion of the bottoms stream to provide a heated bottoms stream;

passing the heated bottoms stream to a second separation zone having a column and being configured to provide a naphtha stream comprising at least heavy naphtha, a distillate stream comprising at least heavy distillate, and a residue stream;

passing a stripping gas into the column in the second separation zone; and, passing the heavy naphtha stream and the heavy distillate stream to a combined hydrotreating zone, the combined hydrotreating zone receiving a gaseous stream comprising hydrogen and containing a catalyst, the combined hydrotreating zone providing a hydrotreated effluent.

12. The process of claim 11 further comprising heating the first separation zone with a hot oil reboiler.

13. The process of claim 11 further comprising separating the bottoms stream from the first separation zone into a liquid phase and a gaseous phase, wherein the liquid phase is heated to provide the heated bottoms stream.

14. The process of claim 13 further comprising passing the gaseous phase of the bottoms stream to the column in the second separation zone.

15. The process of claim 11, wherein the overhead stream from the first separation zone includes light naphtha and wherein the process further comprises:

passing the overhead stream from the first separation zone to a third separation zone having a column and being configured to provide an LPG stream and a light naphtha stream; and, passing the light naphtha stream to the combined hydrotreating zone.

16. The process of claim 11 wherein the bottoms stream from the first separation zone comprises light naphtha.

17. A process for treating multiple hydrocarbon streams, the process comprising:

passing a feed stream to a first separation zone having a column and being configured to provide an overhead stream comprising LPG and a bottoms stream comprising at least naphtha and distillate;

separating the bottoms stream from the first separation zone into a liquid phase and gaseous phase;

heating the liquid phase to formed a heated bottoms stream;

passing the gaseous phase into a second separation zone;

passing the heated bottoms stream to the second separation zone, the second separation zone having a column and being configured to provide a naphtha stream, a distillate stream, and a residue stream;

passing a stripping gas into the column in the second separation zone;

passing the naphtha stream into a combined hydrotreating zone;

passing the distillate stream into the combined hydrotreating zone; and, wherein the combined hydrotreating zone comprises a vessel receiving a gaseous stream comprising hydrogen and containing a hydrotreating catalyst and being operated to provide a hydrotreated effluent, the vessel in the hydrotreating zone being configured to receive both the naphtha stream and the distillate stream at the same time.

18. The process of claim 17 further comprising passing the hydrotreated effluent to a product recovery zone configured to separate the hydrotreated effluent into at least one naphtha product stream and at least one diesel product stream.

19. The process of claim 17 further comprising:

passing the feed stream to the first separation zone having the column and being configured to provide the overhead stream comprising LPG and light naphtha;

and, separating the overhead stream from the first separation zone into an LPG stream and a light naphtha stream in a third separation zone having a column, wherein at least one of the light naphtha stream and the heavy naphtha stream comprise the naphtha stream passed to the combined hydrotreating zone.

* * * * *